United States Patent [19]

Maxwell et al.

[11] Patent Number: 4,466,362

[45] Date of Patent: Aug. 21, 1984

[54] METHOD OF REMOVING SULFUR AND OTHER CONTAMINANTS FROM THE COAL IN COAL-OIL SLURRIES

[75] Inventors: Emanuel Maxwell, Cambridge; David R. Kelland, Lexington, both of Mass.

[73] Assignee: Massachusetts Institute of Technology, Cambridge, Mass.

[21] Appl. No.: 354,459

[22] Filed: Mar. 3, 1982

[51] Int. Cl.[3] ..... F23K 5/00; C10L 1/32

[52] U.S. Cl. ..... 110/347; 44/51; 210/695; 110/218

[58] Field of Search ..... 110/218, 220, 221, 224, 110/342, 343, 347, 261, 262, 263; 210/222, 695; 44/1 SR, 51, 1 A, 1 C

[56] References Cited

U.S. PATENT DOCUMENTS

| | | | |
|---|---|---|---|
| 3,463,310 | 8/1969 | Ergun et al. . | |
| 3,714,942 | 2/1973 | Fischel et al. | 165/66 X |
| 3,878,051 | 4/1975 | Long et al. | 44/1 SR X |
| 3,938,966 | 2/1976 | Kindig et al. | 44/1 R |
| 4,052,170 | 10/1977 | Yan | 44/1 R |
| 4,098,584 | 7/1978 | Kindig et al. | 44/1 R |
| 4,119,410 | 10/1978 | Kindig et al. | 44/1 R |
| 4,155,715 | 5/1979 | Sass et al. | 44/1 SR |
| 4,175,924 | 11/1979 | Kindig et al. | 44/15 R |
| 4,201,140 | 5/1980 | Robinson | 110/347 X |
| 4,209,394 | 6/1980 | Kelland | 210/42 S |
| 4,309,192 | 1/1982 | Kubo et al. | 44/51 |
| 4,330,399 | 5/1982 | Dijkhuis | 44/51 X |

FOREIGN PATENT DOCUMENTS

| | | | |
|---|---|---|---|
| 2616734 | 12/1977 | Fed. Rep. of Germany | 210/695 |
| 337920 | 11/1930 | United Kingdom | 44/1 A |

OTHER PUBLICATIONS

Ward, J. C., "The Structure and Properties of Some Iron Sulphides", pp. 175–206, Review of Pure and Applied Chem., vol. 20.

Maxwell et al., "High Gradient Magnetic Separation in Coal Desulfurization", IEEE Trans. on Mag., vol. Mag-14, No. 5, Sep. 1978, pp. 482–487.

*Primary Examiner*—Henry C. Yuen

*Attorney, Agent, or Firm*—Arthur A. Smith, Jr.; Thomas J. Engellenner

[57] ABSTRACT

An improved method of removing pyritic sulfur and other contaminants from the coil in a coal-oil slurry. In such a slurry, raw pulverized coal is suspended in fuel oil. In practicing the process, the slurry is heated to a temperature of about 220° C., at which temperature hexagonal pyrrhotite is converted to highly ferromagnetic monoclinic pyrrhotite which can be removed by a magnetic separator.

1 Claim, 2 Drawing Figures

METHOD OF REMOVING SULFUR AND OTHER CONTAMINANTS FROM THE COAL IN COAL-OIL SLURRIES

The Government has rights in this invention pursuant to Contract Number NSF-C-670 awarded by the National Science Foundation.

BACKGROUND OF THE INVENTION

The present invention relates to an improved and more efficient method of delivering a coal-oil slurry of reduced sulfur and ash content to the combustion chamber of a boiler.

The continually escalating cost of fuel oil as an energy source and its predicted depletion makes the use of other type fossil fuels as fuel oil substitutes look attractive. The abundance of coal and its accessibility suggests immediate direct substitution of coal for fuel oil wherever possible.

Several factors, however, have retarded the immediate substitution of coal for fuel oil. One such factor is the difficulty in transporting the coal in bulk from the point of origin to the place of intended use. Another important factor to be considered in the substitution of coal for fuel oil is the effect of the coal burning by-products on the ecology. A third factor which has retarded the conversion of oil-burning facilities to coal-burning facilities is the cost of converting oil-burning equipment over to equipment for burning coal.

A compromise to direct substitution of coal for fuel oil is the so-called "coal-oil-slurry". The slurry offers a relatively cheap method for converting oil-burning equipment at least partially to coal firing, without the cost required for major boiler redesign. Furthermore, the slurry can be pumped along a pipeline, thus offering a solution to the coal transport problem.

However, one problem which remains is that of the pollution problems that result from burning most coals. In this regard, it is the sulfur in the coal which presents the most serious pollution problem. The large amount of ash in the stack gases of a coal fired plant is also detrimental to the environment. Ash also causes slagging on boiler tubes and shortens boiler life.

Sulfur in coal occurs both in the organic and inorganic forms. Organic sulfur is chemically bonded into the hydrocarbon structure of the coal and cannot generally be removed by purely physical means like magnetic separation. The inorganic sulfur occurs as iron sulfide mineral inclusions in the coal and can be removed magnetically. In addition, some of the non-sulfur bearing mineral components, which would ultimately form ash, are also magnetic to a degree and can be removed magnetically.

The relative proportions of organic and inorganic sulfur in coal vary with the source of the coal. In many coals from the eastern half of the United States, the proportions are approximately equal; removal of the inorganic component reduces the total sulfur content by half.

The iron sulfides which comprise the inorganic sulfur in coal occur as both pyrite, $FeS_2$, and pyrrhotite whose composition is approximately $Fe_{0.9}S$. Most of the sulfide is pyrite, which in its pure state is hardly magnetic at all. Interlocked with the pyrite, however, are small amounts of pyrrhotite which are rather strongly magnetic and account for the fact that the pyrite can be removed by magnetic separation.

One well-known approach to improve the removal of pyrite in coal is to convert it to the more magnetic pyrrhotite before magnetic separation. Thus, in the prior art procedure, the coal was pulverized and heated to an appropriate temperature for conversion of pyrite to pyrrhotite. Some of the sulfur is released into the atmosphere during the process and provision must be made to collect this to meet environmental requirements. The remainder in the form of pyrrhotite may be extracted magnetically. The heating process should be selective, i.e., the pyrite and not the coal should be heated. In the prior art microwave heating has been employed for this purpose. See U.S. Pat. No. 3,463,310 to Ergun et al. entitled Separation Method. This heating step is energy intensive and the heat is not recovered.

Another method of pyrite removal in the prior art is to pulverize the coal, omit any special pretreatment, slurry the pulverized coal in water and pass the slurry through a magnetic separator. The pyrite particles are retained and the slurried coal passes through. The disadvantage of this technique is that the coal must then be dried or else burned wet; thus each alternative entails a loss of energy.

Although the pulverized coal may be slurried in oil instead of water and then passed through a magnetic separator without pretreatment, as in the case of water slurries, some serious difficulties arise. The heavy fuel oils used in power plant practice are very viscous, even when heated to 130° F., a temperature commonly used for injection into the boiler. Viscosities of the order of hundreds of centipoises are common compared to 1 centipose, the viscosity of water. The effectiveness of magnetic separation decreases directly with the viscosity of the carrier fluid, so the degree of pyrite removal would be poor compared to that with the water slurries.

Another disadvantage of the method of the prior art is that the pyrrhotite component of the pyrite is not always in the optimum magnetic state. Although all pyrrhotite is more strongly magnetic than pyrite, there is an optimum form which is very strongly magnetic. This is the monoclinic form which occurs in a narrow range of stoichiometries in the neighborhood of the composition $Fe_7S_8$. The less strongly magnetic form is hexagonal pyrrhotite and is more common. In the vicinity of 220° C. hexagonal pyrrhotite converts to the monoclinic form. By raising the temperature to 220° C. and then performing a magnetic separation at this temperature, a more complete removal of the sulfides in coal can be achieved. At this temperature the viscosity of the oil is lower by about a factor of 50, thereby further assisting in the magnetic separation process. A certain fraction of the ash-forming minerals in the coal, other than the iron sulfides, are paramagnetic and are also removed in the magnetic separation step. A reduction in the ash component of 20 to 40% is often achieved.

SUMMARY OF THE INVENTION

In accordance with the present invention, a coal-oil slurry is formed and is delivered to the plant for consumption. However, just prior to being combusted in the combustion chamber of the boiler, the slurry is heated to a temperature betweeen the range of 210°–230° C., preferably 220° C., and is then subjected to magnetic separation. By following this procedure, the sulfur content of the coal in the slurry is lowered, less ash is produced, and the energy used to heat the slurry is not lost since it is not necessary to reheat the slurry prior to burning. If, however, the slurry is not to be burned immediately after treatment, most of the heat can be recovered by means of a heat exchanger which transfers heat from the emerging treated stream to the incoming untreated stream.

Furthermore, by following the process of the present invention, constituents which contribute to the formation of ash in the stack gases are also removed along with the sulfur.

Accordingly, it is an object of the present invention to provide an efficient and more economic system for the reduction of sulfur in a coal-oil slurry.

A further object of the present invention is to provide an efficient system in which the heat applied preceding the magnetic separation of the sulfur in coal is not wasted.

A further object of the invention is to effect the removal of ash generating particles from the pulverized coal in a coal-oil slurry and thereby effect a reduction in ash emissions in the stack gases and undesirable accumulation of slag on boiler tubes.

Yet another object of the present invention is to provide a system to effect efficient removal of pyritic sulfur from raw coal suspended in a fuel oil and thus provide an alternative to the present use of pure fuel oil in power plant combustion while maintaining a low level of sulfur oxide emission.

DESCRIPTION OF THE PREFERRED EMBODIMENTS

Figure 1:
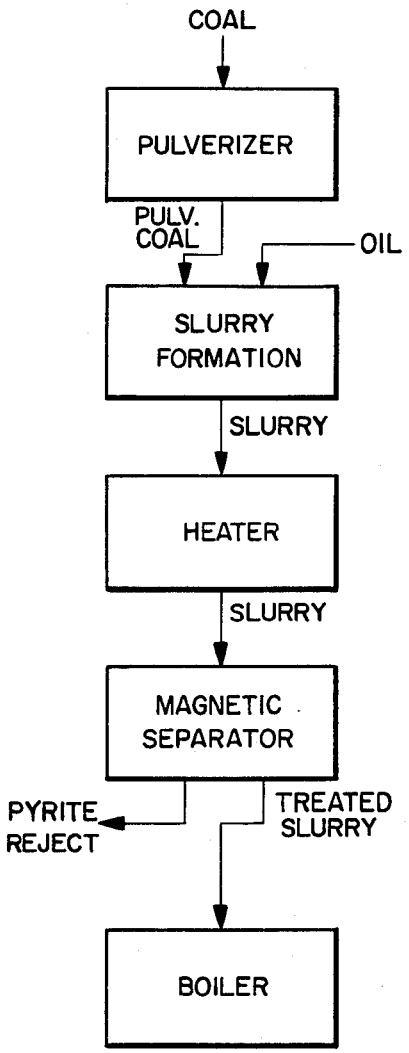
FIG. 1 is a flow diagram setting out the successive steps in carrying out the process of the invention. Coal is fed into a pulverizer in which the raw coal is ground to a size appropriate for the liberation of the pyrite from the coal and for suspension in an oil slurry. It is then passed into a tank in which the coal is slurried together with the oil in the desired proportions. In one important embodiment, it is desirable to first slurry the coal in a lighter oil and then combine that with the heavier oil. In some cases this is automatically accomplished by pulverizing the coal in oil. By this precoating the coal particles with oil, a more stable coal-oil slurry is produced. Following this the slurry goes into a heater in which it is heated to a temperature of 220° C.± approximately 10° C. Following this step the slurry is fed into the magnetic separator. The pyrite is separated out magnetically and is rejected in the reject stream. The processed slurry, from which the pyrite and some of the ash has been removed, is then passed into the boiler and burned.
Figure 2:
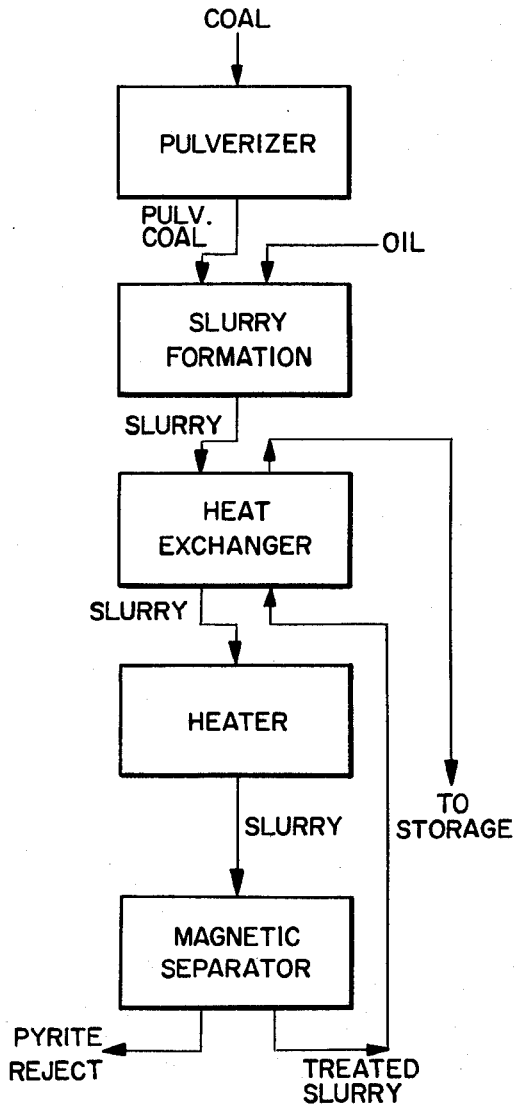
In FIG. 2 a flow diagram is shown in which provision is made for partial recovery of heat in the event that the slurry is not burned immediately after magnetic separation of the pyrite. The treated slurry, at a temperature of approximately 220° C., is passed through the heat exchanger in which some of the energy expended in bringing it up to 220° C. is recovered and transferred to the incoming untreated slurry.

At the outset, the invention is described in its broadest overall aspects with a more detailed description following. In its broadest aspects, the invention is a system in which a coal-oil slurry is heated to effect sulfur removal by magnetic separation and is combusted just after magnetic separation without reheating the slurry.

The heavy fuel oil, i.e., (Bunker C or No. 6) used in power plant generation is very viscous at room temperature and is normally heated in order to inject it into the combustion chamber of the steam boiler. Some extra heating is required to effect magnetic enhancement in accordance with the present invention, but this makes no change in the overall heat balance.

The success of magnetic separation is enhanced by the conversion of non-magnetic, or weakly magnetic iron sulfides, to highly magnetic monoclinic pyrrhotite. Pyrrhotite is a non-stoichiometric compound with the approximate composition $Fe_{0.9}S$ occurring in two crystalline forms: hexagonal pyrrhotite and monoclinic pyrrhotite. The monoclinic form is much more strongly magnetic than the hexagonal form but occurs only in a narrow range of compositions in the neighborhood of 47 atomic percent of iron. At 220° C. conversion from the hexagonal to the monoclinic state is favored—and takes place rapidly; see "The Structure and Properties of Some Iron Sulphides", Reviews of Pure and Applied Chemistry, Vol. 20, p. 175, 1970.

In the course of the work leading to the present invention, it has been discovered that in coal, sulfur appears mostly in the form of pyrites $FeS_2$, which is only marginally paramagnetic, but there are also small amounts of pyrrhotite present in the pyrite particles through the nature conversion of pyrite to pyrrhotite in nature and through the subsequent grinding of the coal to form the necessary small particles for the coal-oil slurry. These sulfides occur as interlocked particles differing in crystalline structure. For maximum efficiency in the system of the present invention, the pyrrohotite entrained into the pyrite should be in the more magnetic monoclinic state so that magnetic separation will be more complete.

To process the slurry (typically 40% coal, 60% oil) prior to combustion, the coal-oil slurry is first passed into a heater, where, at a temperature of about 220° C.±10° C., a phase transition from hexagonal to monoclinic pyrrhotite occurs rapidly; the residence time needed is about 1–5 minutes. The slurry is then passed through a magnetic separator at 220° C.±10° C. For details see U.S. Pat. Nos. 3,567,026 and 3,676,337 to H. H. Kolm, the teachings of which are incorporated herein by reference, in which the magnetic particulates are removed. The desulfurized coal-oil slurry is then fed directly into the combustion chamber of the boiler without reheating.

It has been found that a significant reduction in ash emissions results by following the teachings of the present invention because of the magnetic separation. The separation process removes part of the non-sulfur-bearing paramagnetic mineral matter which would form ash in addition to that fraction of the ash resulting from the oxidation of iron sulfides to iron oxides. Thus, not only is the particulate content of the stack gases reduced, but the amount of non-coal mineral matter injected into the combustion chamber is also reduced with a corresponding reduction in their corrosive and other effects.

The invention is further illustrated by the following non-limiting example:

As an example of a typical process, a slurry can be made using a No. 6 heavy fuel oil with a heating value of 18,500 BTU/lb. and a sulfur content of 0.5% by weight. A typical coal would be an Upper Freeport with the following analysis in percent by weight:

Heating value: =16,000 BTU/lb.

Total sulfur: =1.8%

Organic sulfur: =0.9%
Pyritic sulfur: =0.9%
Ash: =13.0%

The coal would be pulverized to an average size of 15 microns and slurried in the oil to produce a fuel with the following characteristics:

Oil:Coal ratio: =60:40
Heating value: =17,500 BTU/lb.
Total sulfur: =1.0%
Pyritic sulfur: =0.36%
Ash: =5.2%

With no removal of the pyritic sulfur component, the stack gases would contain 0.57 lbs. of sulfur per million BTU. Approximately 90% of the pyritic sulfur can be removed by the process described here, reducing the sulfur content of the emissions to 0.38 lb. per million BTU. At least 20% of the ash would also be removed reducing the ash content of the emissions from 2.4 lb. per million BTU to 1.9 lbs.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A process for the removal of sulfur and other contaminants from the coal in a coal-oil slurry prior to combustion of the slurry comprising:

grinding the coal to a size appropriate for the liberation of pyrite and suspension in an oil slurry;

slurrying the coal with oil;

heating the slurry to a temperature between the range of 210°-230° C. to enhance the magnetic properties of pyrrhotite and pyrite bound thereto;

separating the pyrite magnetically from the heated slurry;

thereafter passing the heated slurry through a heat exchanger in which unheated slurry is passed to recover and transfer heat from the heated slurry to the unheated slurry; and burning the heated slurry in a boiler.

* * * * *